US006357711B1

(12) United States Patent
Heyderman et al.

(10) Patent No.: US 6,357,711 B1
(45) Date of Patent: Mar. 19, 2002

(54) SIGN HOLDER

(75) Inventors: Mark B. Heyderman, Floral Park, NY (US); Richard S. Heyderman, South Plainfield, NJ (US)

(73) Assignee: MBM Presentations, Inc., Floral Park, NY (US)

( * ) Notice: Subject to any disclaimer, the term of this patent is extended or adjusted under 35 U.S.C. 154(b) by 0 days.

(21) Appl. No.: 09/658,984

(22) Filed: Sep. 11, 2000

(51) Int. Cl.[7] ..... A47F 5/00

(52) U.S. Cl. ..... 248/288.31; 40/661.03; 248/223.41

(58) Field of Search ..... 248/288.31, 223.41, 248/224.7, 181.1, 181.2, 291.1, 292.14, 299.1, 316.7, 361.5, 548, 549, 900; 24/350, 327, 489, 545; 40/661.03, 642.01, 484, 493, 492

(56) References Cited

U.S. PATENT DOCUMENTS 76,706 A * 4/1868 Brevoort ..... 403/68
5,111,606 A * 5/1992 Reynolds ..... 40/661.02
5,233,773 A * 8/1993 Reynolds ..... 40/661.03
5,289,652 A * 3/1994 Kringel et al. ..... 40/651
5,617,661 A * 4/1997 Mason ..... 40/642.01
5,697,589 A * 12/1997 Garfinkle ..... 248/223.41
5,918,842 A * 7/1999 Garfinkle ..... 248/223.41
6,012,244 A * 1/2000 Begum et al. ..... 40/661.03
6,202,334 B1 * 3/2001 Reynolds et al. ..... 40/642.02

* cited by examiner

*Primary Examiner*—Ramon O. Ramirez
*Assistant Examiner*—Holly N. Sy
(74) *Attorney, Agent, or Firm*—Young & Thompson

(57) ABSTRACT

A sign holder having a bracket releasably securable to a support, an arm extending horizontally from the bracket, and structure releasably securable to a sign. This structure is supported on the arm at least for limited vertical swinging movement relative to the arm in either direction from a median position in which the sign hangs down vertically from the arm. The arm can have at an outer end a universal joint interconnecting the arm and the support structure, this joint permitting rotation of the support structure about an upright axis and providing for a limited vertical swinging movement of a sign in any direction. The arm can also be hollow and have a slot extending lengthwise of an underside of the arm, the slot being of a length less than the length of the arm, the support structure having at least partially circular bearing surfaces bearing on the interior of the underside of the arm beyond opposite ends of the slot, so that the sign can have only limited vertical swinging movement. The support structure terminates downwardly in a plurality of horizontal lugs, and a keeper is frictionally retainable on the lugs for releasably retaining a sign on the lugs.

10 Claims, 3 Drawing Sheets

SIGN HOLDER

FIELD OF THE INVENTION

The present invention relates to sign holders, particularly but not exclusively of the type used at the point of sale of goods in retail establishments such as grocery stores. The present invention is of particular utility as a sign holder for releasably retaining a sign from the edge of shelving on which merchandise is displayed. Such signs can pertain, among other things, to the price, a description of the merchandise, the announcement of special sales, etc.

OBJECTS OF THE INVENTION

It is accordingly an object of the present invention to provide a sign holder by which a sign can be quickly and easily attached to the edge of a store shelf.

Another object of the present invention is to provide a sign holder which permits limited swinging movement of a sign in at least one direction.

Still another object of the invention is the provision of a sign holder which permits free rotation of a sign about an upright axis.

It is a further object of the invention to provide a sign holder by which a sign can be reliably held but rapidly and easily changed.

Finally, it is an object of the present invention to provide a sign holder which will be relatively simple and inexpensive to manufacture, quick and easy to manipulate, and rugged and durable in use.

BRIEF DESCRIPTION OF THE DRAWINGS

Other objects, features and advantages of the present invention will become apparent from a consideration of the following description, taken in connection with the accompanying drawings, in which.

DETAILED DESCRIPTION OF THE PREFERRED EMBODIMENTS

Figure 1:
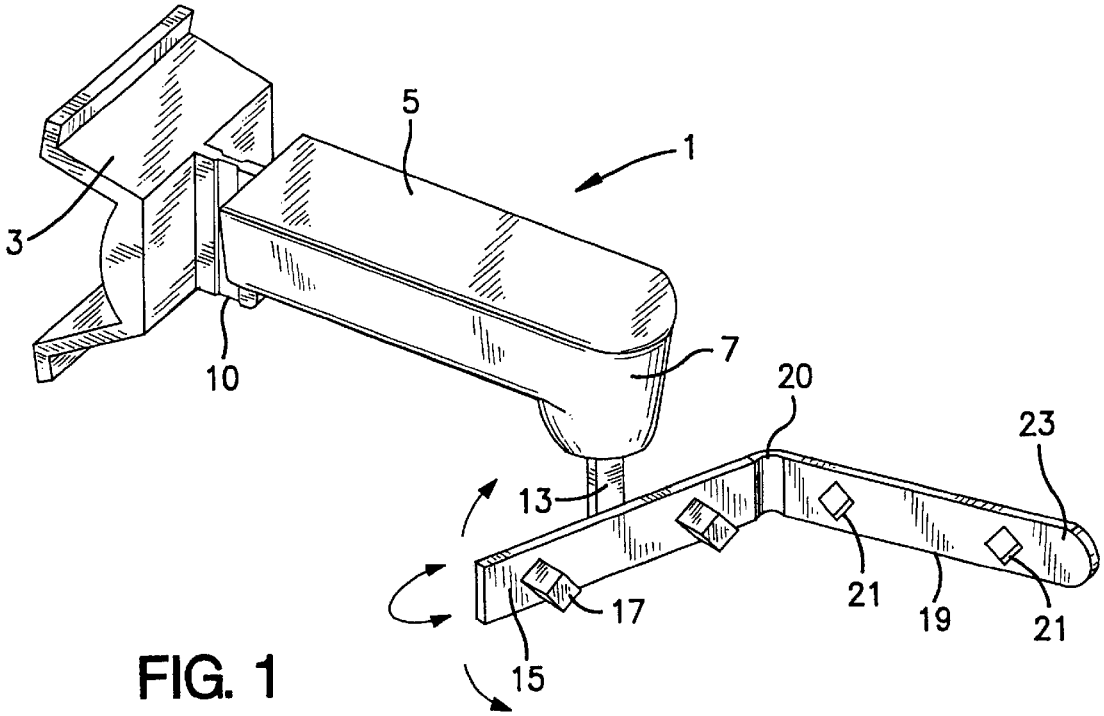
FIG. 1 is a perspective view, with exploded parts, of a first embodiment of a sign holder according to the present invention.

Referring now to the drawings in greater detail, and first to the embodiment shown in FIGS. 1–5 thereof, there is shown a sign holder according to the present invention, generally indicated at 1, comprising a bracket 3 of conventional construction, having vertically spaced resilient legs adapted to be pressed toward each other so that the bracket can be slid into tracks running along the edges of shelves, such as grocery shelves, in a manner well known per se.

Figure 4:
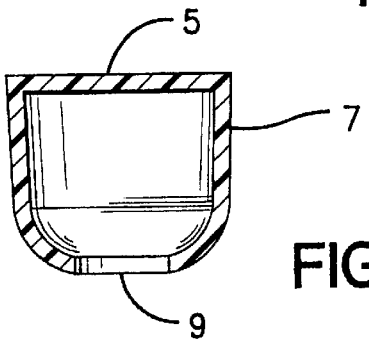
FIG. 4 is a view similar to FIG. 3 but showing only the stationary structure.

Extending horizontally outwardly from bracket 3 is an arm 5 terminating in an outer end 7 from which a sign (not shown) can be suspended. Outer end 7 is hollow and is generally semi-spherical in shape and is in the form of an upwardly opening cup, as best seen in FIG. 4, having at its bottom a circular opening 9.

If the sign holder is made of resilient plastic, the arm 5 can be joined to the bracket 3 by a thinner portion 10 that permits horizontal swinging movement of arm 5 relative to bracket 3 when, for example, a customer brushes against the sign or sign holder, but which automatically restores the sign holder to an extended position thanks to the resiliency of the plastic.

Figure 5:
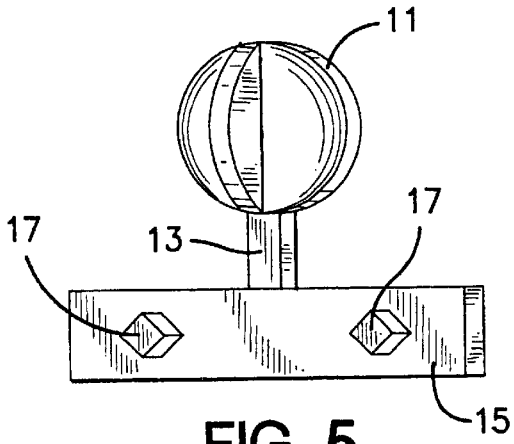
FIG. 5 a view similar to FIG. 3 but showing only the rotatable and swingable structure.

Freely rotatably and swingably received within the cup thus provided by end 7, is a ball 11 which can be spherical but which, for simplicity of construction, can be constituted, as shown in FIG. 5, by four semi-circular, or one circular and two semi-circular, members fixed to each other. Ball 11 is of approximately the same size and curvature as the spherical seat provided by end 7 so as to be freely rotatable and swingable therein; and of course, for this purpose, ball 11 need not be a complete ball but could instead be only the lower half of a ball, whether semi-spherical or constituted by a plurality of ribs. Of course, the number of ribs is optional, provided there are at least three.

Depending from ball 11 is a stem 13 which terminates downwardly in a horizontal bar 15 perpendicular to stem 13. Bar 15 carries a plurality of horizontally outwardly projecting lugs 17, preferably two in number, located adjacent the ends of bar 15. A keeper 19 is adapted to hold a suspended sign (not shown) between itself and the bar 15. When the sign holder is made of resilient plastic, keeper 19 can be secured to bar 15 against loss, by a thinner portion 20. Keeper 19 is releasably retained on bar 15 by the frictional engagement of lugs 17 within correspondingly spaced holes 21 in keeper 19. When pressed together, bar 15 and keeper 19 firmly hold between them a sign punched with holes corresponding to the spacing of lugs 17. To facilitate detachment of keeper 19 from lugs 17, in order to remove the sign or change the sign, a tab 23 extends endwise beyond the adjacent end of bar 15. Thus, keeper 19 can be swung aside and thereafter the sign removed from lugs 17, with the help of tab 23.

Figure 2:
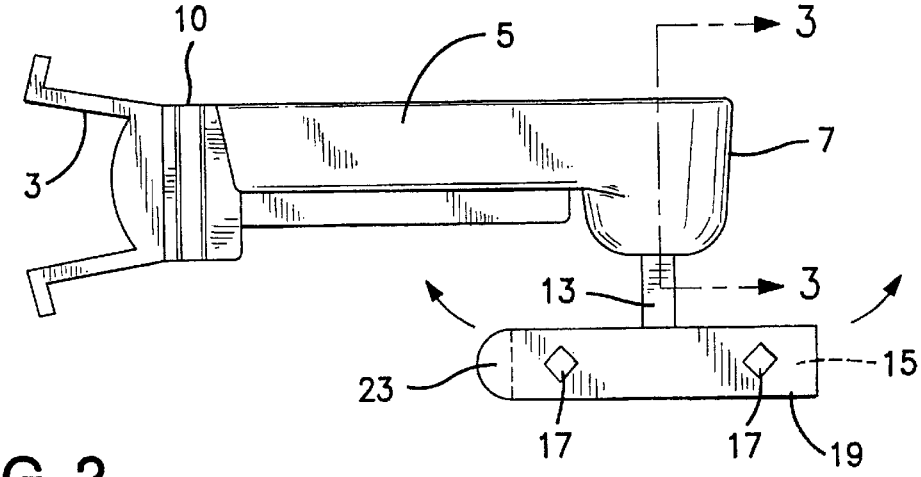
FIG. 2 is a side elevational view thereof.
Figure 3:
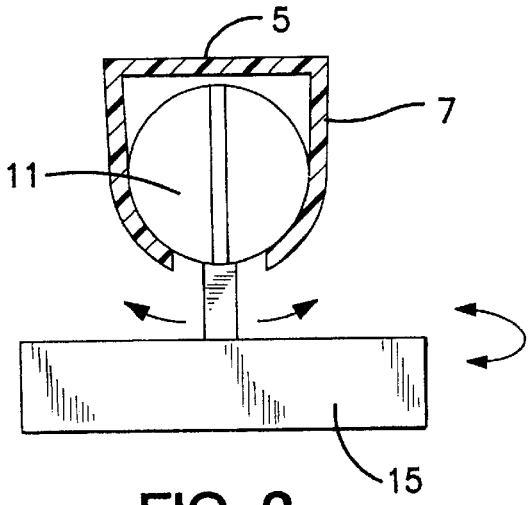
FIG. 3 is a cross-sectional view thereof on the line 3—3 of FIG. 2.

As will be evident from a comparison of FIGS. 2 and 3, the assembly 11, 13, 15, 17, 19, 21, 23 and with it the sign suspended therefrom, is able to rotate freely about any upright axis, and to swing horizontally about the hinge at 10. As is indicated by dashed lines in FIG. 2, is also able to swing vertically, in any direction, by about 15 degrees from the upright position shown in the drawings, due to the fact that the opening 9 is substantially wider than the stem 13.

Vertical swinging movement of the assembly 11, 13, 15, 17, 19, 21, 23 is accordingly stopped by the ultimate contact between stem 13 and the margin of opening 9.

Figure 6:
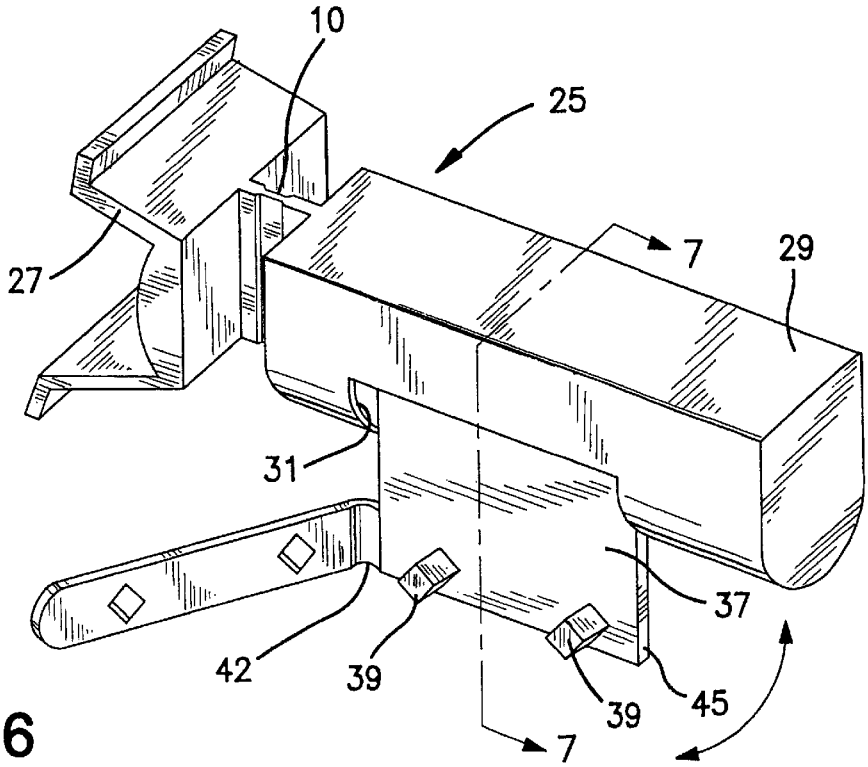
FIG. 6 is a view similar to FIG. 1, showing a second embodiment to the invention.
Figure 7:
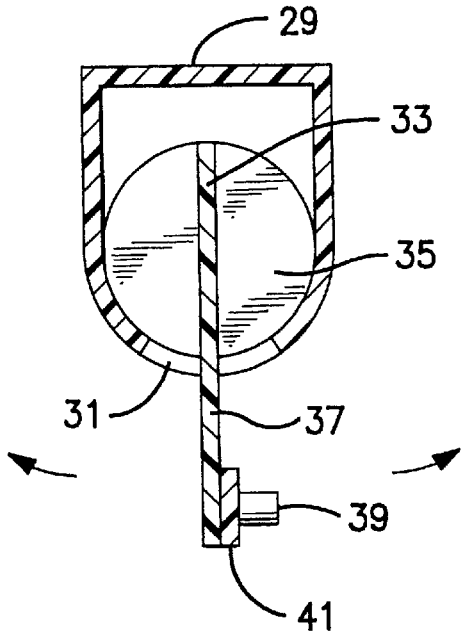
FIG. 7 is a cross-sectional view taken on the line 7—7 of FIG. 6.
Figure 8:
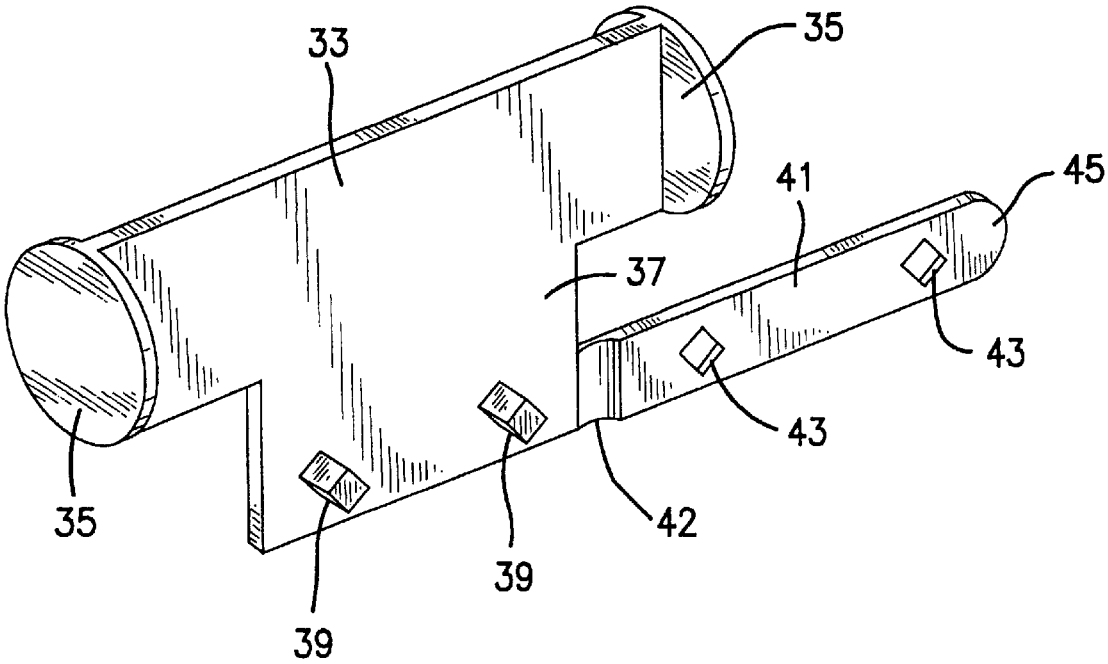
FIG. 8 is an exploded perspective view of the swingable portion of the structure shown in FIG. 7.

A second embodiment of a sign holder 25 according to the present invention is shown in FIGS. 6–8. In the embodiment of these figures, the sign holder has a resilient bracket 27 that can be identical to bracket 3 of FIGS. 1–5. As also in the first embodiment, there is an outwardly extending arm 29, which is hollow, but which has a semi-cylindrical bottom traversed by an elongated slot 31 that extends lengthwise of arm 29 but is spaced a substantial distance from either end of arm 29.

Disposed partially inside and partially outside of hollow arm 29 is a plate 33 which, in its rest position, is disposed in a vertical plane. Plate 33 carries circular end members 35 at either end thereof, the members 35 being perpendicular to plate 33 and fixedly secured thereto. Each member 35 has an outer contour that matches the inner contour of the semi-cylindrical bottom of arm 29 to support plate 33 for vertical swinging movement about a horizontal axis that passes through the centers of end members 35. As also in the case of ball 11 in the previous embodiment, end members 35 could be only semi-circular, and still perform their function of rockingly supporting plate 33 within arm 29.

An extension 37, integral with plate 33, extends downwardly through slot 31 and is of a horizontal length no greater than slot 31 and preferably slightly less than the length of slot 31. Extension 37 carries a plurality of horizontally projecting lugs 39, analogous to lugs 17 in the previous embodiment, and for the same purpose. As also in the first embodiment, lugs 39 are preferably two in number and disposed adjacent the opposite ends of extension 37.

Still further in replication of the first embodiment, a keeper 41, swingingly retained on extension 37 by thinner portion 42, has holes 43 therethrough so as frictionally to receive lugs 39. Keeper 41 has at one end thereof a tab 45, for the same purpose as tab 23 in the first embodiment.

As can be seen from a comparison of FIGS. 6 and 7, the assembly 33, 35, 37, 39, 41, 43, 45 of the second embodiment of the invention can swing vertically about a horizontal axis but, unlike the first embodiment, cannot rotate about a vertical axis other than that provided by thinner portion 10.

Also, analogously to the first embodiment, this vertical swinging of assembly 33–45 is limited by the longitudinal edges of slot 31, so that the assembly 33–45, and with it its supported sign (not shown), can swing vertically by about 15 degrees in either direction from a median position in which the plane of plate 33 is vertical.

It will thus be seen that, in either of the two embodiments, a sign holder is provided in which the sign can be easily applied to the lugs 17 or 39 simply by punching two holes in the sign with the same spacing as the lugs and then pressing the lugs through those holes. The keeper 19 or 41 is then applied to the other side of the sign, by frictionally forcing the lugs through the holes in the keeper. This frictional engagement is sufficient to retain the sign on the holder against inadvertent displacement.

To change the sign, it is necessary only to grasp the tab 23 or 45 on the keeper 19 or 41, and, if desired by holding the rest of the movable assembly in the other hand, pull the keeper off the lugs.

But when the sign is on the lugs and retained by the keeper, then the sign, and with it the movable portion of the sign holder can at least swing vertically a substantial but limited distance in either direction from an exactly upright position, and horizontally about the hinge provided by thinner portion 10. This enables persons brushing past the sign to displace the same without damaging either the sign or the sign holder and without dislodging the sign holder from the edge of the shelf which supports it.

In the embodiment of FIGS. 6–8, the movement of the sign thus is limited to these vertical and horizontal swinging movements. But in the embodiment of FIGS. 1–5, the sign has an additional capability of not only swinging vertically and horizontally, but also rotating about the axis of the stem 13. This broadens the range of movement of the sign, by permitting the sign to assume any such rotated position, at the same time that it is able to swing vertically and horizontally to a limited extent in any direction from that rotated position.

The sign holder of either embodiment can be made entirely from molded plastic.

From a consideration of the foregoing disclosure, therefore, it will be evident that all the initially recited objects of the present invention have been achieved.

Although the present invention has been described and illustrated in connection with preferred embodiments, it is to be understood that modifications and variations may be resorted to, without departing from the scope of the invention as defined by the appended claims.

We claim:

1. A sign holder comprising a bracket releasably securable to a support, an arm extending horizontally from the bracket, and means for releasably securing to a sign, said means being supported on said arm at least for limited vertical swinging movement relative to the arm in either direction from a median position in which the sign hangs down vertically from the arm, said arm being hollow and having a slot extending lengthwise of an underside of the arm, the slot being of a length less than the length of said arm, said means comprising means having at least partially circular bearing surfaces bearing on an interior of the underside of the arm beyond opposite ends of the slot.

2. A sign holder as claimed in claim 1, said arm having at an outer end a universal joint interconnecting said arm and said means, said universal joint permitting rotation of said means about an upright axis and limited vertical swinging movement of a sign in any direction.

3. A sign holder as claimed in claim 2, said universal joint comprising a part-spherical socket carried by the arm, said socket terminating downwardly in an opening, said means comprising a member having at least partially spherical surfaces supported in said socket for universal movement relative to the socket and having a stem depending downwardly through said opening, said stem having releasable sign-retaining means on a lower end of said stem, said opening having a diameter substantially greater than the diameter of the stem so as to permit vertical swinging movement in any direction, of a sign carried by the sign holder.

4. A sign holder as claimed in claim 1, said means comprising a plate having an extension extending downwardly through said slot, said plate having a horizontal extent within said arm substantially greater than the length of the slot and carrying said circular bearing surfaces at opposite ends of said plate.

5. A sign holder as claimed in claim 4, the interior of the underside of the arm beyond opposite ends of the slot having upwardly concave surfaces matching said circular bearing surfaces.

6. A sign holder comprising a bracket releasably securable to a support, an arm extending horizontally from the bracket, and means for releasably securing to a sign, said means being supported on said arm at least for limited vertical swinging movement relative to the arm in either direction from a median position in which the sign hangs down vertically from the arm, said means terminating downwardly in a downwardly extending portion having a plurality of horizontal lugs, and a keeper movable relative to said downwardly extending portion but frictionally retainable on said lugs for releasably retaining a sign on said lugs.

7. A sign holder as claimed in claim 6, and a hinge connecting an end of said downwardly extending portion to an end of said keeper.

8. A sign holder as claimed in claim 6, further comprising a tab on an end of the keeper, said tab extending beyond said downwardly extending portion thereby to facilitate removal of the keeper from said downwardly extending portion.

9. A sign holder comprising a bracket releasably securable to a support, an arm extending horizontally from the bracket, and means for releasably securing to a sign, said means being supported on said arm at least for limited vertical swinging movement relative to the arm in either direction from a median position in which the sign hangs down vertically from the arm, further comprising a resilient hinge connecting the arm and the bracket for horizontal swinging movement of the arm relative to the bracket.

10. A sign holder as claimed in claim 9, wherein said sign holder is resilient plastic, and in which said resilient hinge comprises a thinner portion made of resilient plastic.

* * * * *